US005728234A

United States Patent [19]

Aoki et al.

[11] Patent Number: 5,728,234

[45] Date of Patent: Mar. 17, 1998

[54] COMPOSITION AND PROCESS FOR TREATING THE SURFACE OF ALUMINIFEROUS METALS

[75] Inventors: Tomoyuki Aoki; Masayuki Yoshida, both of Kanagawa-Ken, Japan

[73] Assignee: Henkel Corporation, Plymouth Meeting, Pa.

[21] Appl. No.: 727,590

[22] PCT Filed: Apr. 7, 1995

[86] PCT No.: PCT/US95/03933

§ 371 Date: Oct. 15, 1996

§ 102(e) Date: Oct. 15, 1996

[87] PCT Pub. No.: WO95/28509

PCT Pub. Date: Oct. 26, 1995

[30] Foreign Application Priority Data

Apr. 15, 1994 [JP] Japan ..... 6-077219

[51] Int. Cl.[6] ..... C23C 22/33

[52] U.S. Cl. ..... 148/251; 148/259; 148/260

[58] Field of Search ..... 148/251, 259, 148/260

[56] References Cited

U.S. PATENT DOCUMENTS

| | | | |
|---|---|---|---|
| 4,517,028 | 5/1985 | Lindert | 148/257 |
| 4,795,506 | 1/1989 | Sokalski | 148/257 |

*Primary Examiner*—Sam Silverberg

*Attorney, Agent, or Firm*—Ernest G. Szoke; Wayne C. Jaeschke; Norvell E. Wisdom, Jr.

[57] ABSTRACT

A surface of aluminiferous metal is brought into contact at 30° C. to 65° C. for 5 to 60 seconds with a surface treatment bath with a pH of 2.0 to 6.5 that contains phosphate ion, condensed phosphate ion, and a water soluble polymer in the following weight proportions: 1–30: 0.1–10: 0.2–20. This is followed by a water rinse and drying by heating. The water soluble polymer has a chemical structure conforming with formula (I):

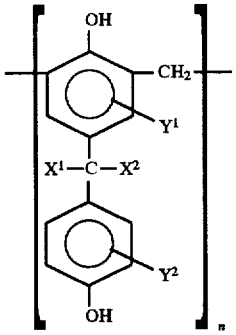

(I)

in which (i) each of $X^1$ and $X^2$ represents a hydrogen atom, a $C_1$ to $C_5$ alkyl group, or a $C_1$ to $C_5$ hydroxyalkyl group; (ii) each of $Y^1$ and $Y^2$ represents a hydrogen atom or a moiety "Z" that conforms to formula (II) or (III):

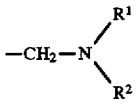

(II)

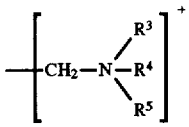

(III)

wherein each of $R^1$, $R^2$, $R^3$, $R^4$, and $R^5$ represents a $C_1$ to $C_{10}$ alkyl group or a $C_1$ to $C_{10}$ hydroxyalkyl group; (iii) the average value for the number of Z moieties substituted on each phenyl ring in the polymer molecule is from 0.2 to 1.0; (iv) n is an integer with a value from 2 to 50; and (v) each polymer molecule contains at least one Z moiety.

12 Claims, No Drawings

COMPOSITION AND PROCESS FOR TREATING THE SURFACE OF ALUMINIFEROUS METALS

TECHNICAL FIELD

This invention relates to a novel composition and method for treating the surface of aluminiferous metals in order thereby to provide such surfaces, prior to their being painted, with an excellent corrosion resistance and paint adherence. The invention may be effectively applied, inter alia, to the surface treatment of drawn-and-ironed (hereinafter usually abbreviated "DI") aluminum cans. When applied to the DI aluminum cans fabricated by the drawing-and-ironing of aluminum alloy sheet, the surface treatment composition and method according to the present invention are particularly effective in providing the surface of such cans, prior to the painting or printing thereof, with an excellent corrosion resistance and paint adherence and also with the excellent slideability required for smooth conveyor transport of the can (abbreviated below simply as "slideability").

BACKGROUND ART

Liquid compositions, which hereinafter are often called "baths" for brevity, even though they may be used by spraying or other methods of establishing intact than immersion, that are useful for treating the surface of aluminiferous metals, defined as aluminum and its alloys that contain at least 45% by weight of aluminum, may be broadly classified into chromate-type treatment baths and non-chromate-type treatment baths. The chromate-type surface treatment baths typically are divided into chromic acid chromate conversion treatment baths and phosphoric acid chromate conversion treatment baths. Chromic acid chromate conversion treatment baths were first used in about 1950 and are still in wide use at present for the surface treatment of, for example, heat exchanger fins and the like. Chromic acid chromate conversion treatment baths contain chromic acid ($CrO_3$) and hydrofluoric acid (HF) as their essential components and may also contain a invention accelerator. These baths from a coating that contains small amounts of hexavalent chromium. The phosphoric acid chromate conversion treatment bath was invented in 1945 (see U.S. Pat. No. 2,438,877). This conversion treatment bath contains chromic acid ($CrO_3$), phosphoric acid ($H_3PO_4$), and hydrofluoric acid (HF) as its essential components. The main component in the coating produced by this bath is hydrated chromium phosphate ($CrPO_4.4H_2O$). Since this conversion coating does not contain hexavalent chromium, this bath is still in wide use at present as, for example, a paint undercoat treatment for the lid and body of beverage cans.

The treatment bath taught in Japanese Patent Application Laid Open [Kokai or Unexamined] Number Sho 52-131937 [131,937/1977] is typical of the non-chromate-type conversion treatment baths. This treatment bath is an acidic (pH= approximately 1.0 to 4.0) waterborne coating solution that contains phosphate, fluoride, and zirconium or titanium or their compounds. Treatment of aluminiferous metal surfaces with this non-chromate-type conversion treatment bath produces thereon a conversion film whose main component is zirconium and/or titanium oxide. The absence of hexavalent chromium is one advantage associated with the non-chromate-type conversion treatment baths; however, the conversion coatings produced by them in many instances exhibit a corrosion resistance and paint adherence that is inferior to those of the coatings generated by chromate-type conversion treatment baths. Moreover, both chromate-type and non-chromate-type conversion treatment baths contain fluorine, which conflicts with the contemporary desire, prompted by environmental concerns, for the practical implementation of fluorine-free surface treatment baths.

The use of water-soluble resins in surface treatment baths and methods intended to provide aluminiferous metals with corrosion resistance and paint adherence is described, for example, in Japanese Patent Application Laid Open [Kokai or Unexamined] Numbers Sho 61-91369 [91,369/1986] and Hei 1-172406 [172,406/1989], Hei 1-177379 [177,379/1989], Hei 1-177380 [177,380/1989], Hei 2-608 [608/1990], and Hei 2-609 [609/1990]. In these examples of the prior art surface treatment baths and methods, the metal surface is treated with a solution containing a derivative of a polyhydric phenol compound. However, the formation of an acceptably stable resin-containing coating on the aluminiferous metal surface sometimes is highly problematic with these prior art methods, and they do not always provide an acceptable performance (corrosion resistance). The invention described in Japanese Patent Application Laid Open [Kokai or Unexamined] Number Hei 4-66671 [66,671/1992] constitutes an improvement to treatment methods that use polyhydric phenol derivatives, but even in this case the problem of an unsatisfactory adherence sometimes arises.

The surface of DI aluminum cans is at present treated mainly with the above-described phosphoric acid chromate surface treatment baths and zirconium-containing non-chromate surface treatment baths. The outside bottom surface of DI aluminum cans is not painted, but is subjected to high-temperature sterilization. If its corrosion resistance is poor, the aluminum will become oxidized at this point and a blackening discoloration will occur, a phenomenon which is generally known as "blackening". In order to prevent blackening, the coating produced by surface treatment must itself, even when unpainted, exhibit a high corrosion resistance.

Turning to another issue, a high friction coefficient for the can's exterior surface will cause the can surface to have a poor slideability during the conveyor transport that occurs in the can fabrication and finishing processes. This will cause the can to tip over, which will obstruct the transport process. Can transportability is a particular concern with regard to transport to the printer. Thus, there is demand in the can fabrication industry for a lowering of the static friction coefficient of the can's exterior surface, which, however, must be achieved without adversely affecting the adherence of the paint or ink which will be coated on the can. The invention disclosed in Japanese Patent Application Laid Open [Kokai or Unexamined] Number Sho 64-85292 [85,292/1989] is an example of a method directed to improving this slideability. This invention relates to a surface treatment agent for metal cans, wherein said surface treatment agent contains water-soluble organic substance selected from phosphate esters, alcohols, monovalent and polyvalent fatty acids, fatty acid derivatives, and mixtures of the preceding. While this method does serve to increase the slideability of aluminum cans, it affords no improvement in corrosion resistance or paint adherence.

The invention described in Japanese Patent Application Laid Open [Kokai or Unexamined] Number Hei 5-239434 [239,434/1993] is another method directed to improving the slideability of aluminum cans. This invention is characterized by the use of phosphate esters. This method does yield an improved slideability, but again it affords no improvement in corrosion resistance or paint adherence.

DISCLOSURE OF THE INVENTION

Problems to Be Solved by the Invention

The present invention is directed to solving the problems described above for the prior art. In specific terms, the present invention introduces a composition and method for treating the surface of aluminiferous metal which are able to provide the surface of aluminiferous metal with an excellent corrosion resistance and paint adherence. When applied in particular to DI aluminum cans, said composition and method impart thereto an excellent slideability in combination with an excellent corrosion resistance and paint adherence.

Details of the Invention, Including Preferred Embodiments Thereof

It has been found that the problems described above for the prior art can be solved through the application of a specific type of surface treatment bath that is prepared using a surface treatment composition containing specific phosphate ions, condensed phosphate ions, and water-soluble polymers with a specific structure. It was found that the application of this surface treatment bath to the surface of aluminiferous metal will form thereon a very corrosion-resistant and highly paint-adherent resin-containing coating. It was also found that application of said bath to DI aluminum cans forms thereon a resin-containing coating that exhibits an improved slideability in addition to an excellent corrosion resistance and paint adherence. The invention was achieved based on these discoveries.

A composition according to the present invention for treating the surface of aluminiferous metal characteristically comprises, preferably consists essentially of, or more preferably consists of, water and, in parts by weight:

(A) from 1 to 30 parts of phosphate ions;

(B) from 0.1 to 10 parts of condensed phosphate ions; and (C) from 0.1 to 20 parts of water-soluble polymer conforming with the following general formula (I)

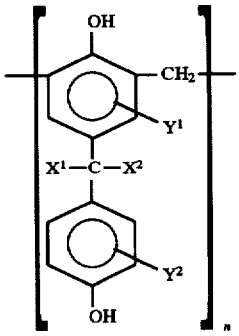

(I)

in which each of $X^1$ and $X^2$ independently of each other and independently from one unit of the polymer, as represented by formula (I) above with the brackets and the subscript n omitted, to another unit of the polymer represents a hydrogen atom, a $C_1$ to $C_5$ alkyl group, or a $C_1$ to $C_5$ hydroxyalkyl group; each of $Y^1$ and $Y^2$ independently of one another and independently for each unit of the polymer represents a hydrogen atom or a moiety "Z" which conforms to one of the following formulas (II) and (III):

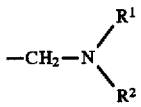

(II)

-continued

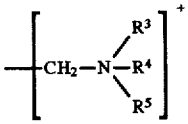

(III)

wherein each of $R^1$, $R^2$, $R^3$, $R^4$, and $R^5$ in formulas (II) and (III) independently represents a $C_1$ to $C_{10}$ alkyl group or a $C_1$ to $C_{10}$ hydroxyalkyl group; the moiety Z bonded to any single phenyl ring in the polymer molecule may be identical to or may differ from the moiety Z bonded to any other phenyl ring in the polymer molecule; the average value for the number of Z moieties substituted on each phenyl ring in the polymer molecule is from 0.2 to 1.0; n, which may be referred to hereinafter as "the average degree of polymerization", has a value from 2 to 50; and each polymer molecule (I) must contain at least one Z moiety-substituted phenyl ring. This average value for the number of Z moieties substituted on each phenyl ring in the polymer molecules of total component (C) is hereinafter referred to as the average value for Z moiety substitution.

Compositions according to the invention as described above may be either working compositions, suitable for directly treating aluminiferous metal substrates, or they may be concentrate compositions, which are useful for preparing working compositions, usually by dilution of the concentrate compositions with water, and optionally, adjustment of the pH of the resulting working composition.

A method according to the present invention for treating the surface of aluminiferous metal characteristically comprises contacting the surface of aluminiferous metal with a surface treatment bath containing the above-described surface treatment composition according to the present invention, then rinsing the treated surface with water, and subsequently drying the surface by heating. Independently, in a method according to the present invention, the bath preferably has a pH value of 6.5 or less, the total time of contacting the metal to be treated preferably is from 5 to 60 seconds, and the temperature during its contact with the aluminiferous metal being treated preferably is from 30° C. to 65° C. The reactivity of the bath may be insufficient below 30° C., preventing the formation of a good-quality film. While a good-quality coating is formed at temperatures above 65° C., the higher energy costs for heating make such temperatures economically undesirable. Coating formation may be inadequate and a highly corrosion-resistant coating may not be produced when the immersion time is less than 5 seconds. Long immersion times in excess of 60 seconds usually produce no additional improvements in performance and are disfavored because of their added expense.

The surface treatment method according to the present invention may be implemented by immersing the aluminiferous metal, preferably for 5 to 60 seconds, in the above-described surface treatment bath. The surface treatment method according to the present invention may also be implemented by spraying the above-described surface treatment bath onto the surface of the aluminiferous metal, preferably at least twice, and preferably with an nonspray interval of from 2 to 5 seconds between each period of continuous spraying and the next period of continuous spraying if there is one. The occurrence of the pH increase in the vicinity of the interface with the surface, which is required for proper coating formation, is less reliable when spray treatment is carried out by continuously spraying the bath, and in some cases a satisfactory film formation will not occur. it is for this reason that use of an intermittent spray is preferred. The total of the spray and nonspray interval time periods preferably is from 5 to 60 seconds. The reaction may be inadequate and a highly corrosion-resistant coating may not be produced when the total contact time is less than 5 seconds. Lengthy total contact times in excess of 60 seconds usually produce no additional improvements in performance and are more expensive.

A surface treatment composition according to the present invention is an acidic aqueous solution whose essential ingredients are phosphate ion, condensed phosphate ion, and water-soluble polymer with the above-specified chemical structure.

Phosphoric acid ($H_3PO_4$), sodium phosphate ($Na_3PO_4$), and the like can be used as the source of the phosphate ion in the surface treatment composition according to the present invention. The phosphate ion content in the above-described formulation ranges from 1 to 30 parts by weight (hereinafter often abbreviated "pbw"), while the preferred range is from 1 to 5 pbw. Reaction between the surface treatment bath and the metal surface will be insufficient and film formation often will be inadequate when the phosphate ions content in the above-described formulation is less than 1 pbw. While a good-quality film is formed with more than 30 pbw of phosphate ions, the high cost of the resulting treatment bath makes such levels economically undesirable.

The condensed phosphate ions used in the present invention conform to the general chemical formula $H_{(p+1-q)}P_pO_{(3p+1)}^{-q}$, where p represents a positive integer that is 2 or greater and q represents a positive integer that is from 1 to (p+1); examples are pyrophosphate ions, tripolyphosphate ions, tetrapolyphosphate ions, and the like. Either the condensed phosphoric acid or its neutral or acid salt can be used as the condensed phosphate ion source for the surface treatment composition according to the present invention. For example, any of pyrophosphoric acid ($H_4P_2O_7$), disodium diacidpyrophosphate ($Na_2H_2P_2O_7$), trisodium acidpyrophosphate ($Na_3HP_2O_7$), and tetrasodium pyrophosphate ($Na_4P_2O_7$), can be used as the source of the pyrophosphate ions. The condensed phosphate ions content in the above-described formulation for the surface treatment composition according to the present invention, measured as its stoichiometric equivalent of completely ionized condensed phosphate anions conforming to the formula $P_pO_{(3p+1)}^{-(p+2)}$, where p and q have the same meanings as above, ranges from 0.1 to 10 pbw, while the preferred range is from 0.5 to 3.0 pbw. Surface treatment baths prepared using less than 0.1 pbw condensed phosphate ion in the above-described formulation usually have only a weak etching activity and provide inadequate film formation. On the other hand, at more than 10 pbw the etching activity generated by the resulting surface treatment bath is too strong, so that the film-forming reactions are inhibited.

Polymer according to formula (I) with n less than 2 yields only an insufficient improvement in the corrosion resistance of the resulting surface coating. The stability of the corresponding surface treatment composition and surface treatment bath is sometimes inadequate and practical problems often ensue in the case of polymer (I) with n greater than 50.

The presence of 6 or more carbons in the alkyl and hydroxyalkyl groups represented by $X^1$ and $X^2$ in formula (I) causes the resulting polymer molecule to be bulky and produces steric hindrance. This usually interferes with the formation of the fine, dense coatings that exhibit excellent corrosion resistance.

Polymer (I) contains the Z moiety as a substituent, and the average value for Z moiety substitution for each phenyl ring in the polymer molecule must range from 0.2 to 1.0. As an example, in a polymer with n=10 that has 20 phenyl rings, if only 10 of these 20 phenyl rings are substituted by one Z moiety each, the average value for Z moiety substitution for this polymer is then calculated as follows: (1×10)/20=0.5.

The polymer usually is insufficiently water soluble when the average value for Z moiety substitution is below 0.2; this results in an insufficiently stable surface treatment concentrate and/or surface treatment bath. When, on the other hand, the average value for Z moiety substitution exceeds 1.0 (substitution of a phenyl ring by 2 or more moieties Z), the resulting polymer becomes so soluble in water that formation of an adequately protective surface film is impeded.

The alkyl and hydroxyalkyl moieties encompassed by $R^1$, $R^2$, $R^3$, $R^4$, and $R^5$ in formulas (II) and (III) should contain from 1 to 10 carbon atoms each. The polymer molecule becomes bulky when this number of carbons exceeds 10; this results in a coarse coating and thereby in an insufficient improvement in the corrosion resistance.

The content of water-soluble polymer (I) in the above-described formulation for the surface treatment composition according to the present invention ranges from 0.1 to 20 pbw, while the range from 0.5 to 5 pbw is preferred. The formation of a coating on the metal surface by the corresponding surface treatment bath often becomes quite problematic when the content of the water-soluble polymer in the above-described formulation is below 0.1 pbw. Values above 20 pbw are economically undesirable due to the increased cost of the surface treatment composition and surface treatment method.

The pH of the surface treatment composition according to the present invention is not narrowly restricted, but adjustment of the pH to values no greater than 6.5, more preferably also not less than 2.0, is generally preferred.

The method according to the present invention is implemented by the preparation of a working surface treatment bath using the above-described surface treatment composition (generally by dilution of a concentrate with water). The pH of the working surface treatment bath at this point is adjusted if necessary to values no greater than 6.5 and preferably to 2.0 to 6.5.

The polymer conforming to formula (I) in the surface treatment bath has a pronounced tendency to deposit or precipitate at a surface treatment bath pH above 6.5; this results in an unsatisfactory stability and service life for the treatment bath. When the pH is below 2.0, the surface treatment bath may etch the metal surface too severely, which can impair formation of the surface coating. The pH of the surface treatment bath may be adjusted using an acid, e.g., phosphoric acid, nitric acid, hydrochloric acid, and the like, or by using alkali, e.g., sodium hydroxide, sodium carbonate, ammonium hydroxide, and the like. Hydrofluoric acid may be used to adjust the pH when waste water treatment presents no problems.

When the aluminum ions eluted from the aluminiferous metal being treated according to the invention mixes into the surface treatment bath, a precipitate may be produced in some cases due to the formation of a complex between polymer (I) and the aluminum ions. An aluminum sequestrant is preferably added to the treatment bath in such cases. Suitable as said aluminum sequestrant are, for example, ethylene diamine tetraacetic acid, Cy-DTA, triethanolamine, gluconic acid, heptogluconic acid, oxalic acid, tartaric acid, malic acid, and organophosphonic acids, but the particular sequestrant selection is not critical. Hydrofluoric acid may be used as the sequestrant when it presents no problems for waste water treatment.

A process according to the present invention preferably is performed by contacting the surface of aluminiferous metal with a surface treatment bath—prepared as described above—at 30° C. to 65° C. for a total of 5 to 60 seconds. The process then continues with a water rinse of the film formed on the metal surface and drying by heating.

Problems with the coating can occur due to foaming of the surface treatment bath when a spray treatment is used. The generation of foam and the intensity of foaming strongly depend on the type of spray equipment and the spraying conditions, and a defoamer is preferably added to the surface treatment bath when a foaming problem cannot be satisfactorily resolved by changes to the spray equipment and/or conditions. Such factors as the type and dispensing level of the defoamer are not critical, provided that they do not impair the paint adherence of the resulting coating.

A preferred method of preparation of a surface treatment composition according to the present invention will now be briefly summarized. To prepare the surface treatment composition, the phosphate ions and condensed phosphate ions are first made up in the above-described proportions and dissolved with thorough stirring in the required amount of water according to the preceding specifications. When the pH of the resulting solution exceeds 7, it is adjusted to less than or equal to 7 using a suitable acid as described above. The water soluble resin specified by the invention is then added while stirring and completely dissolved, and the pH is adjusted to less than or equal to 6.5 as described above.

The coating formed on the surface of aluminiferous metal will now also be briefly discussed. The coating formed by the surface treatment bath according to the present invention is an organic-inorganic composite coating whose main components are phosphate salt and polymer (I). Etching of the metal surface by the phosphate ions and condensed phosphate ions causes a local increase in pH to occur at the interface; this results in deposition of phosphate salt on the metal surface. In addition, the chelating activity of the amino group in polymer (I) may result in the formation of a coordination compound with the fresh substrate surface exposed by etching. The presence of condensed phosphate ions in the surface treatment bath is believed to promote formation of the polymer-metal coordination compound and thereby make possible stable formation of the organic-inorganic composite coating on the surface over a broad pH range.

An additional polymerization of the polymer present on the surface can be induced by heating the surface coating after its formation. In specific cases where an elevated corrosion resistance is required, the coating is preferably heated in order to produce a higher molecular weight for the polymer on the surface. Suitable heating conditions for this purpose are at least 1 minute and at least 200° C.

Aluminiferous metal substrates that may be subjected to the method according to the present invention comprise, for example, the sheet, bar, tube, wire, and like shapes, of aluminum and its alloys, e.g., aluminum-manganese alloys, aluminum-magnesium alloys, aluminum-silicon alloys, and the like. There are absolutely no limitations on the dimensions or shape of the aluminiferous metal.

The polymer composition according to the present invention may contain a preservative or antimold agent. These function to inhibit putrefaction or mold growth when the surface treatment bath is used or stored at low temperatures. Hydrogen peroxide is a specific example in this regard.

The following is a short discussion of further details of a process of treating the surface of aluminiferous metal using the surface treatment bath according to the present invention. The process steps outlined below are a preferred example of application of the surface treatment bath according to the present invention.

(1) Surface cleaning: degreasing—an acidic, alkaline, or solvent-based degreaser may be used.

(2) Water rinse (3) Film-forming treatment (surface treatment method according to the present invention)

(4) Water rinse (5) Rinse with de-ionized water (6) Drying

The invention is illustrated in greater detail below through working examples, and its benefits may be further appreciated by contrast with the comparison examples. The individual surface treatment bath components and surface treatment methods are respectively described in the working and comparative examples.

EXAMPLES

Evaluation Methods (1) Corrosion resistance

The corrosion resistance of the unpainted parts of the DI aluminum cans (resistance to blackening by boiling water) was evaluated based on the degree of discoloration (blackening) after immersion of treated DI aluminum cans in boiling tap water for 30 minutes. The results of this test are reported on the following scale:

+: no blackening

×: partial blackening

××: blackening over entire surface (2) Paint adherence

The paint adherence was tested as follows. The surface of the treated can was coated to a paint film thickness of 5 to 7 micrometers with an epoxy-urea can paint. This was followed by baking for 4 minutes at 215° C. A 5 millimeter (hereinafter usually abbreviated "mm")×150 mm strip was then cut from the painted can and hot-press bonded with polyamide film to give a test specimen. The test specimen thus prepared was subjected to a 180° peel test, during which the peel strength was measured. Higher peel strength values in this test are indicative of a better paint adherence, and peel strength values equal to or greater than 4.0 kilograms-force per 5 millimeters of width (hereinafter usually abbreviated as "kgf/5 mm") are generally regarded as excellent from the standpoint of practical applications.

(3) Slideability

The slideability was evaluated by measuring the static friction coefficient on the outside surface of the can. Lower values for the static friction coefficient are indicative of a better slideability, and values less than or equal to 1.0 are generally regarded as excellent.

Example 1

DI aluminum cans fabricated by the DI processing of A3004 aluminum alloy sheet were cleaned by first degreasing with a 60-second spray at 75° C. of an 8% aqueous solution of PALKLIN™ 500 acidic degreaser manufactured by Nihon Parkerizing Company, Limited and then rinsing with water. The cleaned surface was subsequently sprayed with Surface Treatment Bath 1 (composition given below) heated to 60° C. The spray treatment consisted of 3 sprays of 5 seconds each separated by 5 second intervals for a total of 25 seconds. This was followed in order by rinsing with tap water, spraying for 10 seconds with deionized water (with a resistivity of at least 3,000,000 ohm-cm), and drying in a hot-air drying oven at 180° C. for 2 minutes.

Surface Treatment Bath 1

| | | |
|---|---|---|
| 75% Aqueous phosphoric acid ($H_3PO_4$): | 10.0 g/L | ($PO_4^{-3}$ ions: 7.2 g/L) |
| Sodium pyrophosphate ($Na_4P_2O_7.10H_2O$): | 3.0 g/L | ($P_2O_7^{-4}$ ions: 1.2 g/L) |
| Water-Soluble Polymer 1: | 2.0 g/L | (solids) |

pH: 4.0 (adjusted with sodium hydroxide)
Balance: water

For Water-Soluble Polymer 1, n=5, $X^1$ and $X^2$=hydrogen, Z=—$CH_2N(CH_3)_2$ in formula (I), and the average value for Z moiety substitution=0.25.

Example 2

The DI aluminum cans were cleaned according to the procedure described in Example 1 and then immersed for 20 seconds in Surface Treatment Bath 2 (composition given below) heated to 60° C. This treatment was followed by rinsing with water and drying according to the procedure described in Example 1.

Surface Treatment Bath 2

| | | |
|---|---|---|
| 75% Aqueous phosphoric acid ($H_3PO_4$): | 10.0 g/L | ($PO_4^{-3}$ ions: 7.2 g/L) |
| sodium pyrophosphate ($Na_4P_2O_7 10H_2O$): | 3.0 g/L | ($P_2O_7^{-4}$ ions: 1.2 g/L) |
| Water-Soluble Polymer 1: | 0.4 g/L | (solids) |

pH: 3.0 (adjusted with sodium carbonate)
Balance: water

Water-Soluble Polymer 1 was the same as described in Example 1.

Example 3

The DI aluminum cans were cleaned according to the procedure described in Example 1 and then immersed for 60 seconds in Surface Treatment Bath 3 (composition given below) heated to 35° C. This treatment was followed by rinsing with water and drying according to the procedure described in Example 1.

Surface Treatment Bath 3

| | | |
|---|---|---|
| 75% Aqueous phosphoric acid ($H_3PO_4$): | 20.0 g/L | ($PO_4^{-3}$ ions: 14.4 g/L) |
| Sodium pyrophosphate ($Na_4P_2O_7.10H_2O$): | 6.0 g/L | ($P_2O_7^{-4}$ ions: 2.4 g/L) |
| Water-Soluble Polymer 1: | 8.0 g/L | (solids) |

pH: 6.0 (adjusted with sodium hydroxide)
Balance: water

Water-Soluble Polymer 1 was the same as described in Example 1.

Example 4

The DI aluminum cans were cleaned according to the procedure described in Example 1 and then sprayed with Surface Treatment Bath 4 (composition given below) heated to 65° C. The spray treatment consisted of 3 sprays (6 seconds each) separated by intervals of 2 seconds (total of 22 seconds). This treatment was followed by rinsing with water and drying according to the procedure described in Example 1.

Surface Treatment Bath 4

| | | |
|---|---|---|
| 75% Aqueous phosphoric acid ($H_3PO_4$): | 1.5 g/L | ($PO_4^{-3}$ ions: 1.1 g/L) |
| Sodium pyrophosphate ($Na_4P_2O_7.10H_2O$): | 5.0 g/L | ($P_2O_7^{-4}$ ions: 2.0 g/L) |
| Water-Soluble Polymer 1: | 4.0 g/L | (solids) |

pH: 2.5 (adjusted with nitric acid)
Balance: water

Water-Soluble Polymer 1 was the same as described in Example 1.

Example 5

The DI aluminum cans were cleaned according to the procedure described in Example 1 and then immersed for 30 seconds in Surface Treatment Bath 5 (composition given below) heated to 60° C. This treatment was followed by rinsing with water and drying according to the procedure described in Example 1.

Surface Treatment Bath 5

| | | |
|---|---|---|
| 75% Aqueous phosphoric acid ($H_3PO_4$): | 30.0 g/L | ($PO_4^{-3}$ ions: 21.6 g/L) |
| Sodium tripolyphosphate ($Na_5P_3O_{10}$): | 1.2 g/L | ($P_3O_{10}^{-5}$ ions: 0.8 g/L) |
| Water-Soluble Polymer 1: | 2.0 g/L | (solids) |

pH: 3.5 (adjusted with sodium hydroxide)
Balance: water

Water-Soluble Polymer 1 was the same as described in Example 1.

Example 6

The DI aluminum cans were cleaned according to the procedure described in Example 1 and then sprayed with Surface Treatment Bath 6 (composition given below) heated to 60° C. The spray treatment consisted of 2 sprays of 5 seconds each separated by an interval of 5 seconds for a total of 15 seconds). This treatment was followed by rinsing with water and drying according to the procedure described in Example 1.

Surface Treatment Bath 6

| | | |
|---|---|---|
| 75% Aqueous phosphoric acid ($H_3PO_4$): | 10.0 g/L | ($PO_4^{-3}$ ions: 7.2 g/L) |
| Sodium pyrophosphate ($Na_4P_2O_7.10H_2O$): | 3.0 g/L | ($P_2O_7^{-4}$ ions: 1.2 g/L) |
| Water-Soluble Polymer 2: | 2.0 g/L | (solids) |

pH: 5.0 (adjusted with sodium hydroxide)
Balance: water

For Water-Soluble Polymer 2, in formula (I), n=5, $X^1$ and $X^2$=—$C_2H_5$, and Z=—$CH_2N(CH_2CH_2OH)_2$, and the average value for Z moiety substitution=1.0.

Example 7

The DI aluminum cans were cleaned according to the procedure described in Example 1 and then immersed for 30 seconds in Surface Treatment Bath 7 (composition given below) heated to 60° C. This treatment was followed by rinsing with water and drying according to the procedure described in Example 1.

Surface Treatment Bath 7

| | | |
|---|---|---|
| 75% Aqueous phosphoric acid ($H_3PO_4$): | 10.0 g/L | ($PO_4^{-3}$ ions: 7.2 g/L) |
| Sodium pyrophosphate ($Na_4P_2O_7.10H_2O$) | 3.0 g/L | ($P_2O_7^{-4}$ ions: 1.2 g/L) |
| Water-Soluble Polymer 3: | 2.0 g/L | (solids) |

pH: 4.0 (adjusted with sodium hydroxide)

Balance: water

For Water-Soluble Polymer 3, in formula (I), n=2, $X^1$ and $X^2$=—$C_2H_5$, and Z=—$CH_2N(CH_2CH_2CH_2OH)_2$, and the average value for Z moiety substitution=0.6.

Comparative Example 1

The DI aluminum cans were cleaned according to the procedure described in Example 1 and then sprayed with Surface Treatment Bath 8 (composition given below) heated to 60° C. The spray treatment consisted of 5 sprays of 4 seconds each separated by intervals of 5 seconds each, for a total of 40 seconds. This treatment was followed by rinsing with water and drying according to the procedure described in Example 1.

Surface Treatment Bath 8

| | | |
|---|---|---|
| 75% Aqueous phosphoric acid ($H_3PO_4$): | 10.0 g/L | ($PO_4^{-3}$ ions: 7.2 g/L) |
| Water-Soluble Polymer 1: | 2.0 g/L | (solids) |

pH: 3.0 (adjusted with sodium carbonate)

Balance: water

Water-Soluble Polymer 1 was the same as described in Example 1.

Comparative Example 2

The DI aluminum cans were cleaned according to the procedure described in Example 1 and then immersed for 30 seconds in Surface Treatment Bath 9 (composition given below) heated to 60° C. This treatment was followed by rinsing with water and drying according to the procedure described in Example 1.

Surface Treatment Bath 9

| | | |
|---|---|---|
| 75% Aqueous phosphoric acid ($H_3PO_4$): | 1.0 g/L | ($PO_4^{-3}$ ions: 0.72 g/L) |
| Water-Soluble Polymer 1: | 2.0 g/L | (solids) |

pH: 7.0 (adjusted with sodium hydroxide)

Balance: water

Water-Soluble Polymer 1 was the same as described in Example 1.

Comparative Example 3

The DI aluminum cans were cleaned according to the procedure described in Example 1 and then immersed for 5 seconds in Surface Treatment Bath 10 (composition given below) heated to 60° C. This treatment was followed by rinsing with water and drying according to the procedure described in Example 1.

Surface Treatment Bath 10

| | | |
|---|---|---|
| 75% Aqueous phosphoric acid ($H_3PO_4$): | 10.0 g/L | ($PO_4^{-3}$ ions: 7.2 g/L) |
| Sodium pyrophosphate ($Na_4P_2O_7.10H_2O$): | 1.0 g/L | ($P_2O_7^{-4}$ ions: 0.4 g/L) |
| Water-Soluble Polymer 1: | 0.05 g/L | (solids) |

pH: 4.0 (adjusted with sodium carbonate)

Balance: water

Water-Soluble Polymer 1 was the same as described in Example 1.

Comparative Example 4

The DI aluminum cans were cleaned according to the procedure described in Example 1 and then immersed for 20 seconds in Surface Treatment Bath 11 (composition given below) heated to 60° C. This treatment was followed by rinsing with water and drying according to the procedure described in Example 1.

Surface Treatment Bath 11

| | | |
|---|---|---|
| 95% Aqueous sulfuric acid ($H_2SO_4$): | 2.0 g/L | ($SO_4^{-2}$ ions: 1.9 g/L) |
| Sodium pyrophosphate ($Na_4P_2O_7.10H_2O$): | 1.0 g/L | ($P_2O_7$ ion: 0.4 g/L) |
| Water-Soluble Polymer 1: | 0.05 g/L | (solids) |

pH: 3.5 (adjusted with sodium carbonate)

Water-Soluble Polymer 1 was the same as described in Example 1.

Comparative Example 5

The DI aluminum cans were cleaned according to the procedure described in Example 1 and then immersed for 30 seconds in Surface Treatment Bath 12 (composition given below) heated to 60° C. This treatment was followed by rinsing with water and drying according to the procedure described in Example 1.

Surface Treatment Bath 12

| | | |
|---|---|---|
| 75% Aqueous phosphoric acid ($H_3PO_4$): | 1.0 g/L | ($PO_4^{-3}$ ions: 0.72 g/L) |
| Sodium pyrophosphate ($Na_4P_2O_7.10H_2O$): | 1.0 g/L | ($P_2O_7^{-4}$ ions: 0.4 g/L) |
| Water-Soluble Polymer 4: | 2.0 g/L | (solids) |

pH: 4.0 (adjusted with sodium hydroxide)

Balance: water

For Water-Soluble Polymer 4, in formula (I), n=5, $X^1$ and $X^2$=—$C_2H_5$, and Z=—$CH_2SO_3H$, and the average value for —$CH_2SO_3H$ substitution=0.6.

Comparative Example 6

The DI aluminum cans were cleaned according to the procedure described in Example 1 and then immersed for 30 seconds in Surface Treatment Bath 13 (composition given below) heated to 60° C. This treatment was followed by rinsing with water and drying according to the procedure described in Example 1.

Surface Treatment Bath 13 (surface treatment bath described in Japanese Patent Application Laid Open [Kokai or Unexamined] Number Hei 4-66671)

| | | |
|---|---|---|
| 75% Aqueous phosphoric acid ($H_3PO_4$): | 1.0 g/L | ($PO_4^{-3}$ ions: 0.72 g/L) |
| Sodium pyrophosphate ($Na_4P_2O_7.10H_2O$): | 1.0 g/L | ($P_2O_7^{-4}$ ions: 0.4 g/L) |
| Water-Soluble Polymer 5: | 2.0 g/L | (solids) |

pH: 4.0 (adjusted with sodium hydroxide)

Balance: water

Water-Soluble Polymer 5 had the following formula (IV):

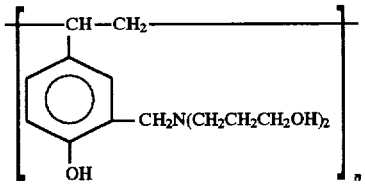

(IV)

n = 20

Comparative Example 7

The DI aluminum cans were cleaned according to the procedure described in Example I and then immersed for 30 seconds in Surface Treatment Bath 14 (composition given below) heated to 60° C. This treatment was followed by rinsing with water and drying according to the procedure described in Example 1.

Surface Treatment Bath 14

| | | |
|---|---|---|
| 75% Aqueous phosphoric acid ($H_3PO_4$): | 1.0 g/L | ($PO_4^{-3}$ ions: 0.72 g/L) |
| Sodium pyrophosphate ($Na_4P_2O_7.10H_2O$): | 1.0 g/L | ($P_2O_7^{-4}$ ions: 0.4 g/L) |
| Water-Soluble Polymer 6: | 2.0 g/L | (solids) |

pH: 4.0 (adjusted with sodium hydroxide)

Balance: water

Water-Soluble Polymer 6 had the following formula (V) (resin described in Japanese Patent Application Laid Open [Kokai or Unexamined] Number Hei 2-608):

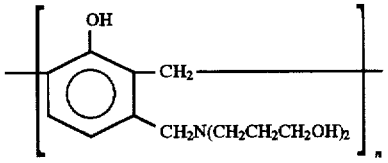

(V)

n = 10

Comparative Example 8

The DI aluminum cans were cleaned according to the procedure de-DINE® 404 non-chromate surface treatment agent, manufactured by Nihon Parkerizing Company, Limited, heated to 40° C. This spray treatment consisted of 3 sprays of 5 seconds each separated by 5 second intervals for a total of 25 seconds. This treatment was followed by rinsing with water and drying according to the procedure described in Example 1.

The evaluation results for Examples 1 to 7 and Comparative Examples 1 to 8 are reported in Table 1.

TABLE 1

Results of the Evaluations

| Example or Comparison Example Number | Blackening Resistance | Peel Strength, kgf/5 mm | Coefficient of Static Friction |
|---|---|---|---|
| Example 1 | + | 4.0 | 0.9 |
| Example 2 | + | 4.0 | 0.9 |
| Example 3 | + | 4.0 | 0.9 |
| Example 4 | + | 4.0 | 0.9 |
| Example 5 | + | 4.0 | 0.9 |
| Example 6 | + | 4.0 | 0.9 |
| Example 7 | + | 4.0 | 0.9 |
| Comparative Example 1 | x | 2.0 | 1.3 |
| Comparative Example 2 | x x | 1.5 | 1.5 |
| Comparative Example 3 | x x | 2.0 | 1.5 |
| Comparative Example 4 | x x | 1.5 | 1.5 |
| Comparative Example 5 | x x | 1.5 | 1.6 |
| Comparative Example 6 | + | 2.0 | 1.1 |
| Comparative Example 7 | x x | 1.5 | 1.6 |
| Comparative Example 8 | + | 4.0 | 1.6 |

As the results in Table 1 make clear, Examples 1 to 7, which used surface treatment compositions and surface treatment methods according to the present invention, yielded surface-treated metals with an excellent blackening resistance, excellent adherence, and excellent slideability. In contrast to this, satisfactory values could not be simultaneously obtained for all these properties (corrosion resistance, paint adherence, and slideability) in the case of the surface-treated metals afforded by surface treatment baths outside the scope of the present invention (Comparative Examples 1 to 8).

Benefits of the Invention

As the preceding description has made clear, the surface treatment composition and surface treatment method according to the present invention can produce very corrosion-resistant and highly paint-adherent conversion coatings on the surface of aluminiferous metals prior to the painting thereof. In particular, application of the surface treatment composition according to the present invention to the treatment of DI aluminum cans results in the formation on the surface of DI aluminum cans prior to its painting or printing of a very corrosion-resistant and highly paint-adherent film that also provides the excellent slideability required for smooth conveyor transport of the can. Since the surface treatment composition according to the present invention and the surface treatment bath used in the invention method do not contain chromium or fluorine, they have the excellent advantage of reducing the load on waste water treatment.

The invention claimed is:

1. An aqueous liquid composition for treating the surface of aluminiferous metals, either as such or after dilution with additional water, said composition comprising water and:

(A) from 1 to 30 pbw of phosphate ions;

(B) from 0.1 to 10 pbw of condensed phosphate ions; and (C) from 0.1 to 20 pbw of water-soluble polymer conforming with the following general formula (I)

(I)

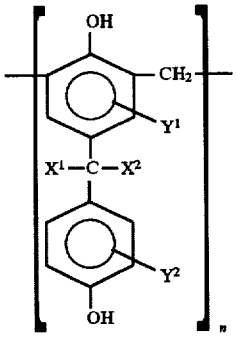

in which (i) each of $X^1$ and $X^2$, independently of each other and independently from one unit of the polymer, which is defined as a part of the polymer that conforms with formula (I) above except that the brackets and the subscript n are omitted, to another unit of the polymer, represents a hydrogen atom, a $C_1$ to $C_5$ alkyl group, or a $C_1$ to $C_5$ hydroxyalkyl group; (ii) each of $Y^1$ and $Y^2$, independently of one another and independently from one unit of the polymer to another, represents a hydrogen atom or a moiety "Z" that conforms to formula (II) or (III):

(II)

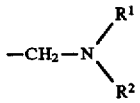

(III)

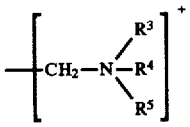

wherein each of $R^1$, $R^2$, $R^3$, $R^4$, and $R^5$, independently of each other and independently from one unit of the polymer to another, represents a $C_1$ to $C_{10}$ alkyl group or a $C_1$ to $C_{10}$ hydroxyalkyl group; (iii) the moiety Z bonded to any single phenyl ring in the polymer molecule may be identical to or may differ from the moiety Z bonded to any other phenyl ring in the polymer molecule; (iv) the average value for the number of Z moieties substituted on each phenyl ring in the polymer molecule is from 0.2 to 1.0; (v) n is an integer with a value from 2 to 50; and (vi) each polymer molecule contains at least one Z moiety.

2. A composition according to claim 1, comprising from 1 to 5 pbw of phosphate ions, from 0.5 to 3 pbw of condensed phosphate ions, and from 0.5 to 5 pbw of water soluble polymer conforming with formula (I).

3. A composition according to claim 2, having a pH value from 2.0 to 6.5 and comprising from 1 to 30 g/L of phosphate ions, from 0.1 to 10 g/L of condensed phosphate ions, and from 0.1 to 20 g/L of water soluble polymer conforming with formula (I).

4. A composition according to claim 1, having a pH value not greater than 6.5 and comprising from 1 to 30 g/L of phosphate ions, from 0.1 to 10 g/L of condensed phosphate ions, and from 0.1 to 20 g/L of water soluble polymer conforming with formula (I).

5. A process for treating a surface of aluminiferous metal, said process comprising steps of:

(I) contacting the surface of aluminiferous metal for from 5 to 60 seconds at from 30° C. to 65° C. with a composition according to claim 4;

(II) after completion of step (I), separating the surface of aluminiferous metal from contact with a composition according to claim 4 and rinsing the surface with water; and (III) drying by heating the surface of aluminiferous metal rinsed in step (II).

6. A process according to claim 5, wherein step (I) is accomplished by immersing the aluminiferous metal surface in the composition.

7. A process according to claim 5, wherein step (I) is accomplished by spraying the composition on to the aluminiferous metal surface.

8. A process according to claim 7, wherein: the aluminiferous metal surface is sprayed at least twice; periods of contact by spraying are interrupted by nonspraying intervals of from 2 to 5 seconds; and total time between completing the first spraying and ending the last spraying is from 5 to 60 seconds.

9. A process for treating a surface of aluminiferous metal, said process comprising steps of:

(I) contacting the surface of aluminiferous metal for from 5 to 60 seconds at from 30° C. to 65° C. with a composition according to claim 3;

(II) after completion of step (I), separating the surface of aluminiferous metal from contact with a composition according to claim 3 and rinsing the surface with water; and (III) drying by heating the surface of aluminiferous metal rinsed in step (II).

10. A process according to claim 9, wherein step (I) is accomplished by immersing the aluminiferous metal surface in the composition.

11. A process according to claim 10, wherein step (I) is accomplished by spraying the composition on to the aluminiferous metal surface.

12. A process according to claim 11, wherein: the aluminiferous metal surface is sprayed at least twice; periods of contact by spraying are interrupted by nonspraying intervals of from 2 to 5 seconds; and total time between completing the first spraying and ending the last spraying is from 5 to 60 seconds.

* * * * *

UNITED STATES PATENT AND TRADEMARK OFFICE

CERTIFICATE OF CORRECTION

PATENT NO. : 5,728,234
DATED : March 17, 1998
INVENTOR(S) : Tomoyuki Aoki, et al.

It is certified that error appears in the above-identified patent and that said Letters Patent is hereby corrected as shown below:

On the title page, insert item [56]:

U. S. PATENT DOCUMENTS

| EXAMINER INITIAL | | PATENT NUMBER | | | | | | | ISSUE DATE | PATENTEE | CLASS | SUBCLASS | FILING DATE IF APPROPRIATE |
|---|---|---|---|---|---|---|---|---|---|---|---|---|---|
| | | 2 | 4 | 3 | 8 | 8 | 7 | 7 | 3/30/48 | Spruance, Jr. Frank | | | |
| | | 4 | 1 | 4 | 8 | 6 | 7 | 0 | 4/10/79 | Kelly, Timm L. | | | |
| | | 4 | 9 | 7 | 0 | 2 | 6 | 4 | 11/13/90 | Lindert, et al | | | |
| | | 5 | 0 | 6 | 3 | 0 | 8 | 9 | 11/5/91 | Lindert, et al | | | |
| | | 5 | 2 | 4 | 6 | 5 | 0 | 7 | 9/21/93 | Kodama, et al | | | |
| | | 5 | 0 | 3 | 9 | 7 | 7 | 0 | 8/13/91 | Lindert, et al | | | |
| | | 5 | 1 | 1 | 6 | 9 | 1 | 2 | 5/26/92 | Lindert, et al | | | |
| | | 5 | 2 | 6 | 6 | 4 | 1 | 0 | 11/30/93 | Lindert, et al | | | |
| | | 4 | 9 | 6 | 3 | 3 | 9 | 6 | 10/16/90 | Lindert, et al | | | |
| | | 5 | 0 | 6 | 8 | 2 | 9 | 9 | 11/26/91 | Lindert, et al | | | |
| | | 5 | 3 | 7 | 0 | 9 | 0 | 9 | 12/6/94 | Tanaka, et al | | | |
| | | 5 | 0 | 3 | 0 | 3 | 2 | 3 | 7/9/91 | Awad, Sami B. | | | |

FOREIGN PATENT DOCUMENTS

| | | DOCUMENT NUMBER | | | | | | | PUBLICATION DATE | COUNTRY OR PATENT OFFICE | CLASS | SUBCLASS | TRANSLATION YES | TRANSLATION NO |
|---|---|---|---|---|---|---|---|---|---|---|---|---|---|---|
| | 52 | | 1 | 3 | 1 | 9 | 3 | 7 | 11/5/77 | Japan | | | | |
| | 1 | | 1 | 7 | 2 | 4 | 0 | 6 | 7/7/89 | Japan | | | | |
| | 1 | | 1 | 7 | 7 | 3 | 7 | 9 | 7/13/89 | Japan | | | | |
| | 1 | | 1 | 7 | 7 | 3 | 8 | 0 | 7/13/89 | Japan | | | | |
| | 2 | | 0 | 0 | 0 | 6 | 0 | 8 | 1/5/90 | Japan | | | | |
| | 2 | | 0 | 0 | 0 | 6 | 0 | 9 | 1/5/90 | Japan | | | | |
| | 4 | | 0 | 6 | 6 | 6 | 7 | 1 | 3/3/92 | Japan | | | | |
| | 5 | | 2 | 3 | 9 | 4 | 3 | 4 | 9/17/93 | Japan | | | | |

Signed and Sealed this

Eleventh Day of July, 2000

*Attest:*

Q. TODD DICKINSON

*Attesting Officer*

*Director of Patents and Trademarks*